United States Patent [19]

Shimozono

[11] Patent Number: 5,007,034

[45] Date of Patent: Apr. 9, 1991

[54] OPERATION INDICATOR OF TIMEPIECE AND SO ON

[75] Inventor: Shigeru Shimozono, Tokyo, Japan

[73] Assignee: Seikosha Co., Ltd., Japan

[21] Appl. No.: 421,178

[22] Filed: Oct. 13, 1989

[30] Foreign Application Priority Data

Oct. 13, 1988 [JP] Japan ..... 63-133829[U]

[51] Int. Cl.[5] ..... G04B 19/20; G04B 19/04

[52] U.S. Cl. ..... 368/77; 368/80; 368/223

[58] Field of Search ..... 368/76, 80, 77, 223, 368/233–235

[56] References Cited

U.S. PATENT DOCUMENTS 2,051,611 8/1936 Liner ..... 368/77

4,605,311 8/1986 Loitz ..... 368/77

FOREIGN PATENT DOCUMENTS 4535872 11/1970 Japan ..... 368/233

316845 10/1956 Switzerland ..... 368/233

757036 9/1956 United Kingdom ..... 368/233

*Primary Examiner*—Vit W. Miska

*Attorney, Agent, or Firm*—Bruce L. Adams; Van C. Wilks

[57] ABSTRACT

A device featuring an hour hand, a minute hand, and an operation indicating disk which are secured at the end of an hour hand shaft, a minute hand shaft, and a second hand shaft, respectively. The shafts are fitted coaxially and pass through a dial. The operation indicating disk is located at a central concave portion of the minute hand and a transparent cover is provided.

18 Claims, 3 Drawing Sheets

OPERATION INDICATOR OF TIMEPIECE AND SO ON

BACKGROUND OF THE INVENTION

The present invention relates to a timepiece operation indicator.

In conventional clocks, a second hand indicates the operation or a light-emitting element such as an LED flickers at the dial.

However, exposed-hand-type clocks having a second hand with no front cover may not correctly indicate the time because human fingers may accidentally contact the second hand when turning a minute hand with the fingers to correct the time. The clocks having a flickering light-emitting element have a complicated system, causing an increase in cost.

SUMMARY OF THE INVENTION

The present invention provides an operation indicator of simplified construction applicable to exposed-hand-type timepieces.

The inventive device features an hour hand, a minute hand, and an operation indicating disk which are secured at the end of an hour hand shaft, a minute hand shaft, and a second hand shaft, respectively. The shafts are fitted coaxially and pass through a dial. The operation indicating disk is located at a central concave portion of the minute hand and a transparent cover is provided.

BRIEF DESCRIPTION OF THE DRAWINGS

The drawings show an embodiment of the operation indicator for timepieces and specifically the operation indicator applied to a timer.

DETAILED DESCRIPTION OF THE INVENTION

One embodiment of the invention as applied to a timer will be described with reference to the drawings.

Figure 1:
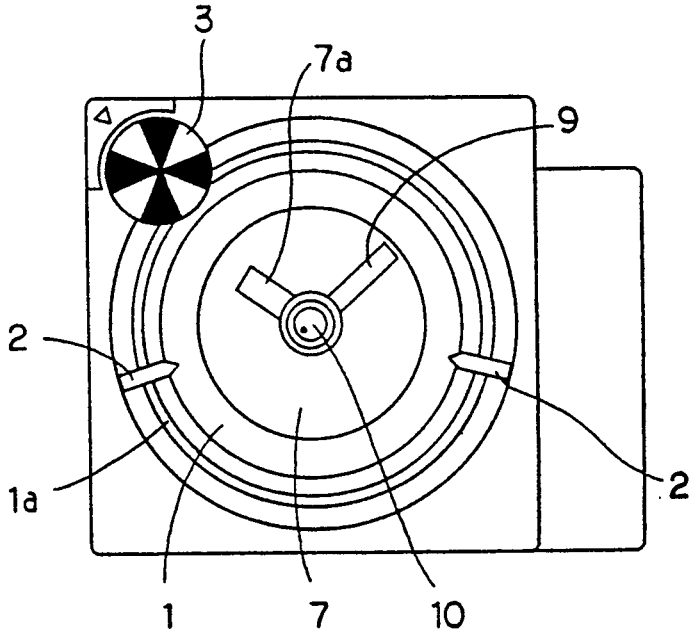
FIG. 1 shows a front view.

As shown in FIG. 1, setting pieces 2 for setting desired times are mounted on a groove 1*a* that extends around the periphery of a dial 1. The dial 1 turns at a rate of one revolution for 24 hours and a timer contact system (not illustrated) is controlled by the movement of the setting pieces 2. An indication plate 3 is provided to indicate the on/off operation of the timer contact.

Figure 3:
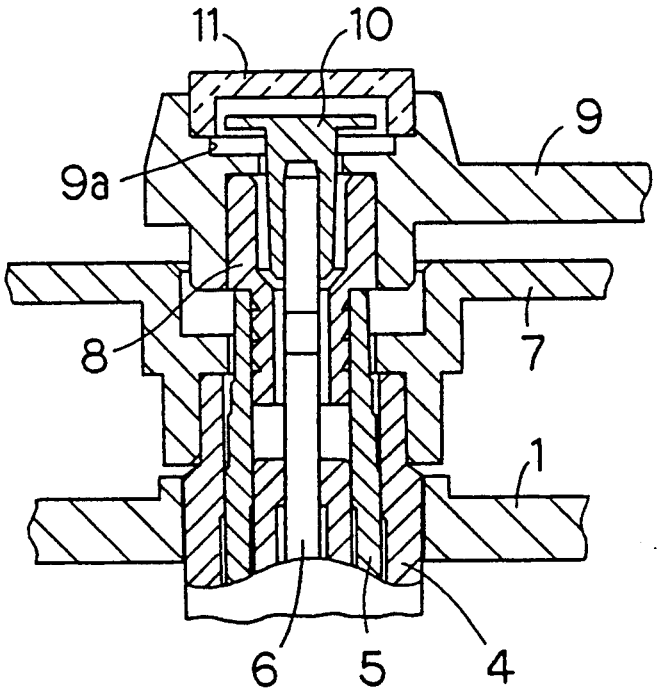
FIG. 3 the cross section thereof.

As shown in FIG. 3, an hour hand shaft 4, a minute hand shaft 5, and a second hand shaft 6 are coaxially fitted and extended through an opening in the dial 1.

A disk-type hour hand 7 is secured at the end of the hour hand shaft 4. An hour hand mark 7*a* is provided on the surface of the hour hand disk 7 as shown in FIGS. 1 and 2.

A minute hand 9 is secured at the end of the minute hand shaft 5 through a minute-hand securing pipe 8, and an operation indicating member in the form of a disk 10 is secured at the end of the second hand shaft 6. The operation indicating disk 10 rotates in a central concave portion or opening 9*a* of the minute hand 9 and does not extend beyond the top end of the minute hand 9 as shown in FIG. 3.

Figure 2:
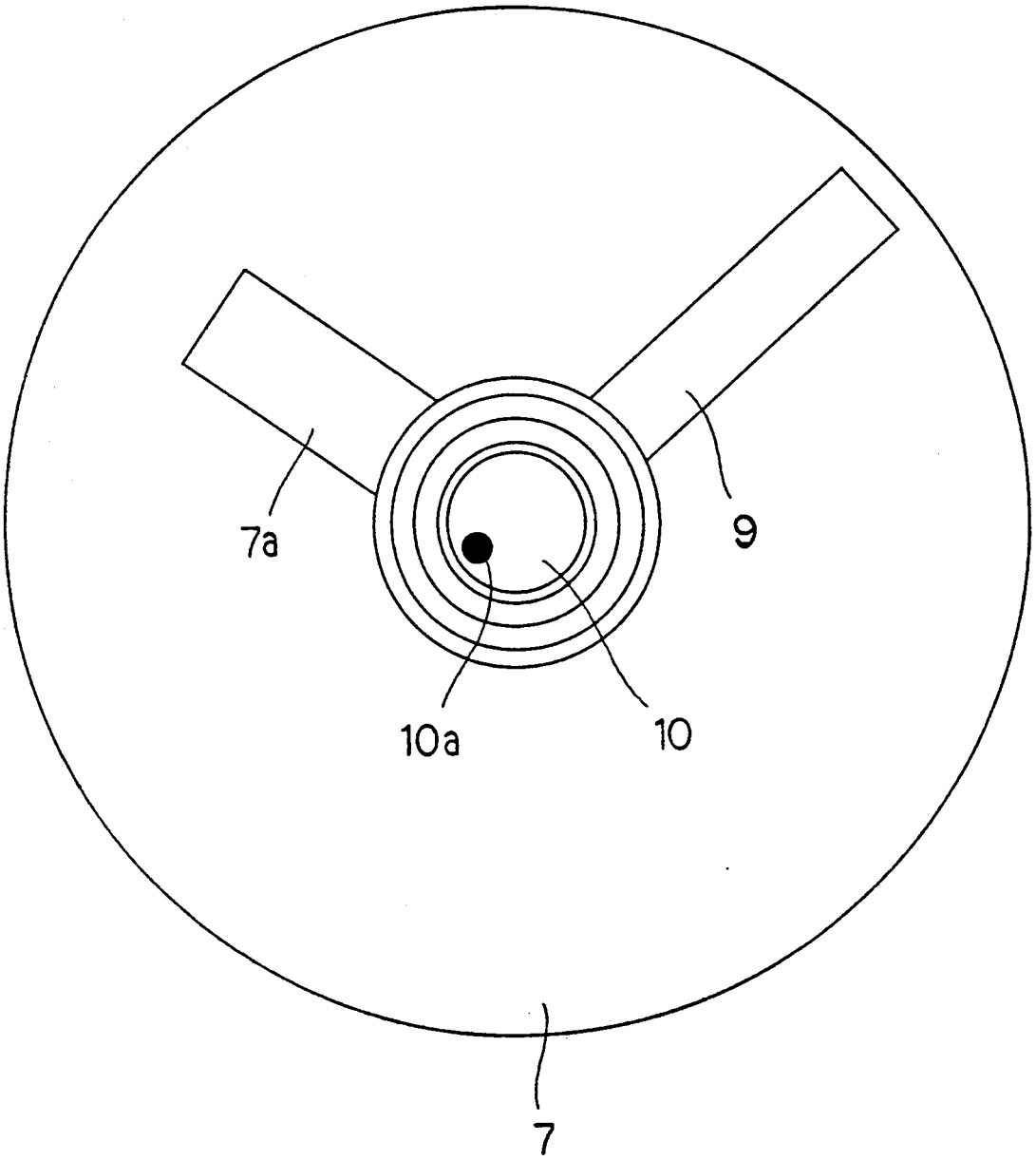
FIG. 2 an enlarged front view of the main part.

A mark 10*a* is put on the surface of the operation indicating disk 10 as shown in FIGS. 1 and 2 so as to be visible when viewing the front face of the dial 1, and movement of the mark 10*a* indicates the operation of the timer. A transparent cover 11 to protect the operation indicating disk 10 is mounted in the opening or central concave portion 9*a* of the minute hand 9 and engages with a stepped peripheral wall of the opening.

Though the embodiment shows an example of the indicator applied to a timer, it is not restricted to a timer.

The indicator device makes it possible to configure clocks and timers provided with an operation indicator more compactly by making full use of space by installing an operation indicating disk at a central concave portion of the minute hand. Moreover, because the operation indicating disk is driven with a small torque by the second hand shaft and is protected by the transparent cover installed at the central concave portion of the minute hand, it is most suitable for the exposed-hand-type clocks and timers.

I claim:

1. An operation indicator comprising: an hour hand shaft, a minute hand shaft, and a second hand shaft coaxially fitted and extending through a dial; an hour hand and a minute hand having a central concave portion and being secured at the end of said hour and minute hand shafts respectively; an operation indicating disk secured at the end of said second hand shaft and disposed at the central concave portion of said minute hand; and a transparent cover installed at said central concave portion.

2. In a timepiece: a dial having a front face and having an opening therein; rotatable hour hand, minute hand and second hand shafts extending coaxially through the dial opening and extending beyond the dial front face; an hour-indicating member connected to the hour hand shaft to undergo rotation therewith in front of the dial; a minute-indicating member connected to the minute hand shaft to undergo rotation therewith in front of the dial and having a central opening therein; and an operation indicating member connected to the second hand shaft to undergo rotation therewith and disposed within the central opening in the minute-indicating member so as to be visible when viewing the dial front face to indicate the operation status of the timepiece.

3. A timepiece according to claim 2; wherein the operation indicating member has a distinguishable marking thereon to indicate the operation status of the timepiece.

4. A timepiece according to claim 3; including a transparent cover mounted in the central opening in the minute-indicating member to cover the operation indicating member.

5. A timepiece according to claim 4; wherein the operation indicating member has a disk portion which is visible when viewing the dial front face.

6. A timepiece according to claim 4; wherein the hour-indicating member comprises an hour disk having an hour-indicating marking thereon.

7. A timepiece according to claim 6; wherein the minute-indicating member comprises a minute hand.

8. A timepiece according to claim 7; wherein the hour disk and minute hand are freely exposed on the dial front face.

9. A timepiece according to claim 2; including a transparent cover mounted in the central opening in the minute-indicating member to cover the operation indicating member.

10. A timepiece according to claim 9; wherein the operation indicating member has a disk portion which is visible when viewing the dial front face.

11. A timepiece according to claim 10; wherein the hour-indicating member comprises an hour disk having an hour-indicating marking thereon.

12. A timepiece according to claim 9; wherein the hour-indicating member comprises an hour disk having an hour-indicating marking thereon.

13. A timepiece according to claim 12; wherein the minute-indicating member comprises a minute hand.

14. A timepiece according to claim 13; wherein the hour disk and minute hand are freely exposed on the dial front face.

15. A timepiece according to claim 2; wherein the central opening in the minute-indicating member has a stepped peripheral wall portion; and a transparent cover mounted in the central opening in engagement with the stepped peripheral wall portion to cover the operation indicating member.

16. A timepiece according to claim 15; wherein the hour-indicating and minute-indicating members are freely exposed on the dial front face.

17. A timepiece according to claim 16; wherein the hour-indicating member comprises an hour disk having an hour-indicating marking thereon.

18. A timepiece according to claim 17; wherein the minute-indicating member comprises a minute hand.

* * * * *